US005131239A

United States Patent [19]

Wilson

[11] Patent Number: 5,131,239

[45] Date of Patent: Jul. 21, 1992

[54] AUTOMATIC SELF-COOLING DEVICE FOR BEVERAGE CONTAINERS

[76] Inventor: John J. Wilson, 723 Camino Plaza, Suite 181, San Bruno, Calif. 94066

[21] Appl. No.: 658,027

[22] Filed: Feb. 20, 1991

Related U.S. Application Data

[63] Continuation-in-part of Ser. No. 286,525, Dec. 19, 1988, abandoned, which is a continuation-in-part of Ser. No. 118,413, Oct. 6, 1987, Pat. No. 4,791,789.

[51] Int. Cl.[5] ..... F25D 27/00

[52] U.S. Cl. ..... 62/293; 62/371

[58] Field of Search ..... 62/293, 371; 251/63

[56] References Cited

U.S. PATENT DOCUMENTS

| | | | |
|---|---|---|---|
| 3,229,478 | 1/1966 | Alonso | 62/371 |
| 3,269,141 | 8/1966 | Weiss | 62/294 |
| 3,320,767 | 5/1967 | Whalen | 62/294 |
| 3,726,106 | 4/1973 | Jaeger | 62/294 |
| 3,874,557 | 4/1975 | Porter | 222/80 |

*Primary Examiner*—William E. Tapolcai
*Attorney, Agent, or Firm*—Howard Cohen

[57] ABSTRACT

A discrete, internal self-cooling device installed in a standard beverage can during assembly that operates on the principle of heat loss through vaporization. A refrigerant vessel is provided for holding a cryogenic refrigerant. The vessel includes a refrigerant vessel body made up of cylindrical side walls having upper and lower rims, an upper plug sealing the upper end of the vessel and a lower plug sealing a lower medial portion of the vessel. The upper plug includes a metering orifice extending axially therethrough, and the lower plug includes a hole extending therethrough and aligned with the metering orifice. A piston is received within the vessel between the lower rim and the lower plug, and includes a rod-like piston extension extending through the lower plug hole. The piston extension includes a tip dimensioned to be received in the metering orifice in sealing fashion. An edible sealant is applied to the outer edge of the piston and to the piston extension, and the sealant is freezable to temporarily hold the piston and extension tip in a sealing position in the metering orifice during assembly and filling of the vessel with cryogenic refrigerant.

8 Claims, 13 Drawing Sheets

AUTOMATIC SELF-COOLING DEVICE FOR BEVERAGE CONTAINERS

CROSS REFERENCE TO RELATED APPLICATION

This application is a continuation-in-part of application Ser. No. 07/286,525, filed Dec. 19, 1988, now abandoned, which is a continuation-in-part of application Ser. No. 07/118,413, filed Oct. 6, 1987, now U.S. Pat. No. 4,791,789, issued Dec. 20, 1988.

FIELD OF THE INVENTION

This invention relates generally to self-cooling or self-heating comestible containers, and more specifically to an automatic internal self-cooling device for a beverage container.

BACKGROUND OF THE INVENTION

Self-cooling beverage containers have not met with widespread commercial success due to design deficiencies of economy, operability, manufacture, process, health and safety, or convenience. In most cases, manufacture has been impractical due to complexities arising from the integral construction of the beverage container and the self-cooling apparatus that resulted in expensive tooling or expensive and extensive modification of the beverage can assembly and fill process. A recent example is the self-cooling can disclosed in the April, 1987 issue of Popular Science, page 53, showing a self-cooling can which includes a scored capillary tube that is lead into a $CO_2$ container, internal to the beverage can. When the scored tube is broke, the $CO_2$ is released and cools the beverage. However, integration of the construction of the integrated container into a beverage can in the manner disclosed in this article would be so expensive as to render this system unmarketable.

Further, efficient cryogenic refrigerants were seldom considered so that refrigerant volumes were too large, displacing too much beverage. The device of Weiss, U.S. Pat. No. 3,269,141, suggests the possibility of frostbite from touching the over-cooled refrigerant cartridge. Industrial refrigerants were recommended in some prior devices, but they are malodorous and possibly poisonous.

SUMMARY OF THE INVENTION

Therefore, it is an object of this invention to provide an economical, discrete, internal self-cooling device to be used inside standard beverage containers.

A further objective of this invention is to provide an efficient, self-cooling device using cryogenic refrigerants such as produced from inert atmospheric gases. These minimize the refrigerant volume and maximize the beverage volume within the standard sized container.

Another objective herein is to provide a healthful, self-cooling device whose atmospheric refrigerant is neither malodorous nor poisonous.

Another objective herein is to provide a convenient self-cooling device that operates automatically upon opening the beverage container.

Further, it is an objective herein to provide a self-cooling device composed of simple, easily manufactured components.

Another objective is to provide a self-cooling device for use in a beverage container which is adapted to various beverage container shapes and sizes.

A related objective is to provide a self-cooling device compatible with various material requirements for economy, material recycling, convenience, and the like.

These and other objectives are realized in a discrete, internal self-cooling device installed in a standard beverage can during assembly that operates, preferably, on the principle of heat loss through vaporization. In a preferred embodiment, a refrigerant vessel is provided for holding a cryogenic refrigerant. The vessel includes a refrigerant vessel body made up of cylindrical side walls with a cylinder vent hole formed through it near the upper refrigerant vessel rim. The vessel sidewalls terminate in upper and lower plugs which seal the vessel. The upper plug includes a regulated refrigerant escape rate means comprising a metering orifice that extends through the plug axially. Intersecting this metering orifice, and automatic pressure actuated release means comprises a transverse plug cylinder containing a pressure actuated piston having a piston groove that opens or closes the orifice, depending on its alignment with the orifice. Means are provided for thermally insulating the refrigerant vessel from surfaces of the can comprising thermal transfer fin-spacers that have large areas contacting the beverage, but small areas contacting the can, and small areas contacting the refrigerant vessel.

In an alternative embodiment, the cylinder of the regulating device is defined below the lower plug of the vessel, in an extended region of the can, and the piston moves in this lower extended region. The piston carries a rod that extends up through the lower plug and enters the metering orifice, with the rod being withdrawn from the metering orifice by the release of pressure in the can when the can is opened. In a similar fashion, in the preferred embodiment, the piston in the transverse plug cylinder is moved, moving the piston groove into or out of alignment with the metering orifice, depending on changes in pressure in the beverage can that are transmitted to the piston through the cylinder vent hole which is formed near the vessel rim adjacent to the cylinder.

Further objects and advantages of this invention will become apparent to a person of skill in the art who studies the ensuing drawings and description of a preferred embodiment.

DESCRIPTION OF A PREFERRED EMBODIMENT

Figure 1:
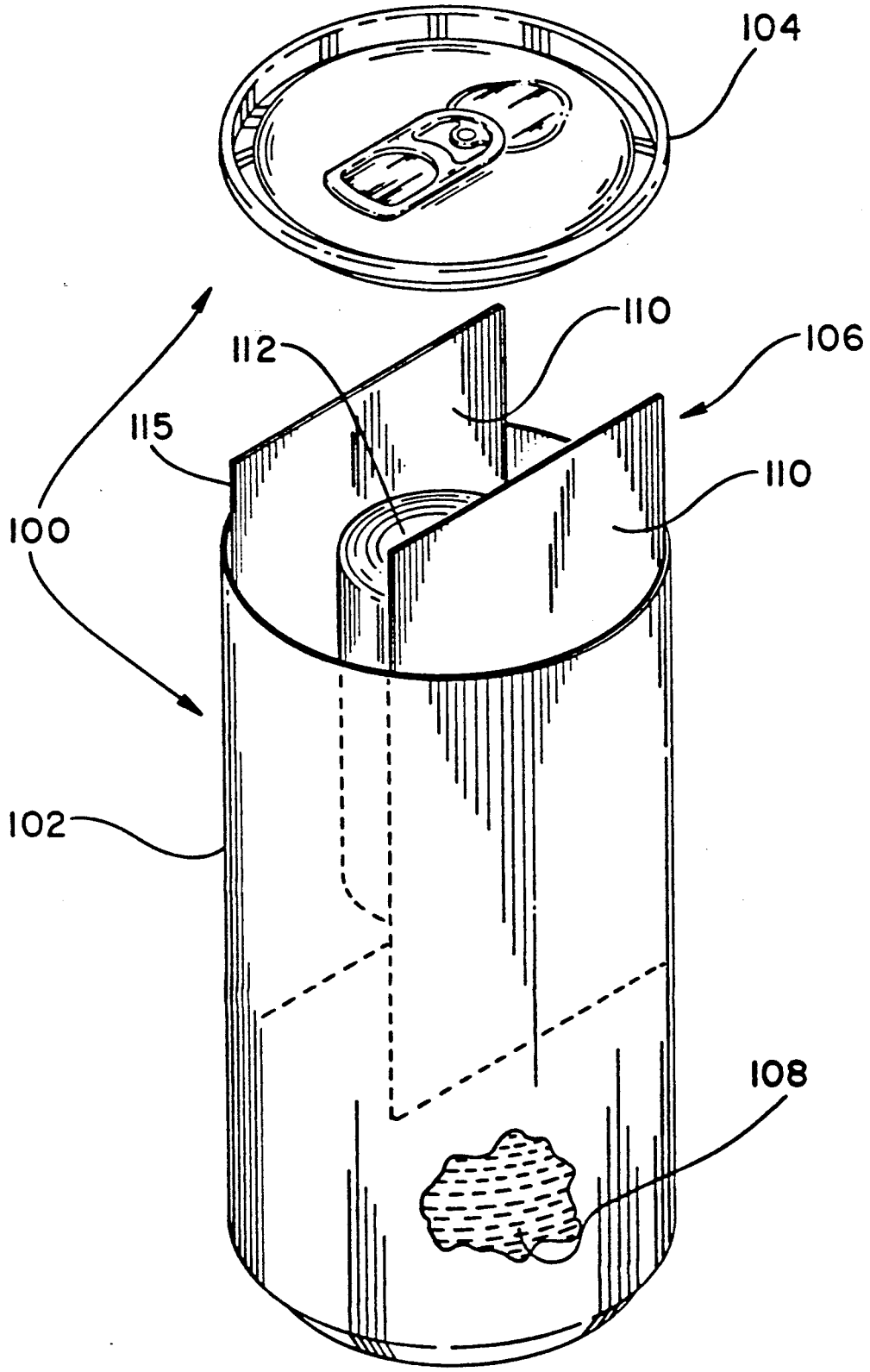
FIG. 1 shows an exploded isometric view, partially in phantom, of a self-cooling device partially inserted into a beverage can body.
Figure 2:
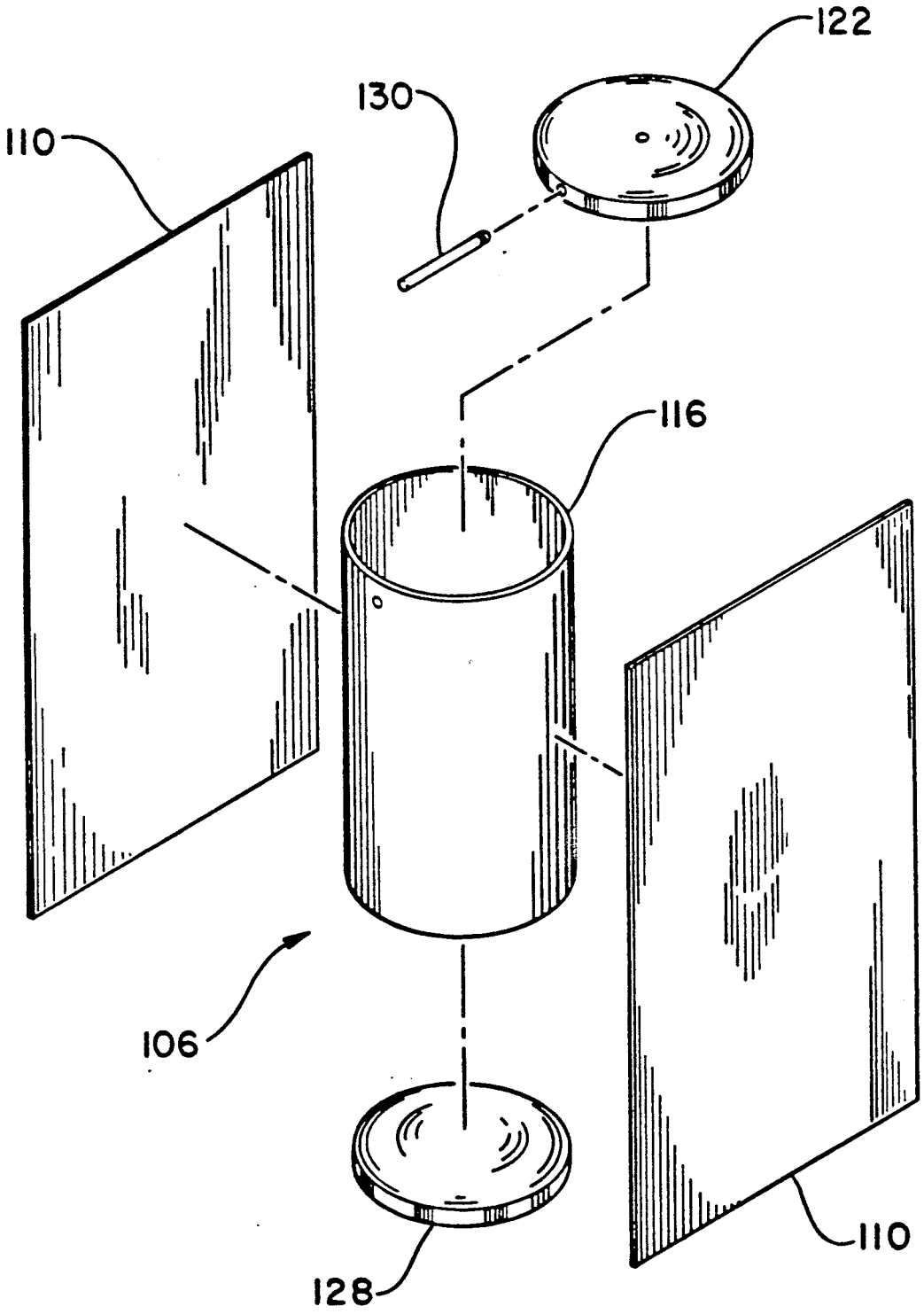
FIG. 2 shows an exploded view of a preferred embodiment of a self-cooling device.
Figure 3:
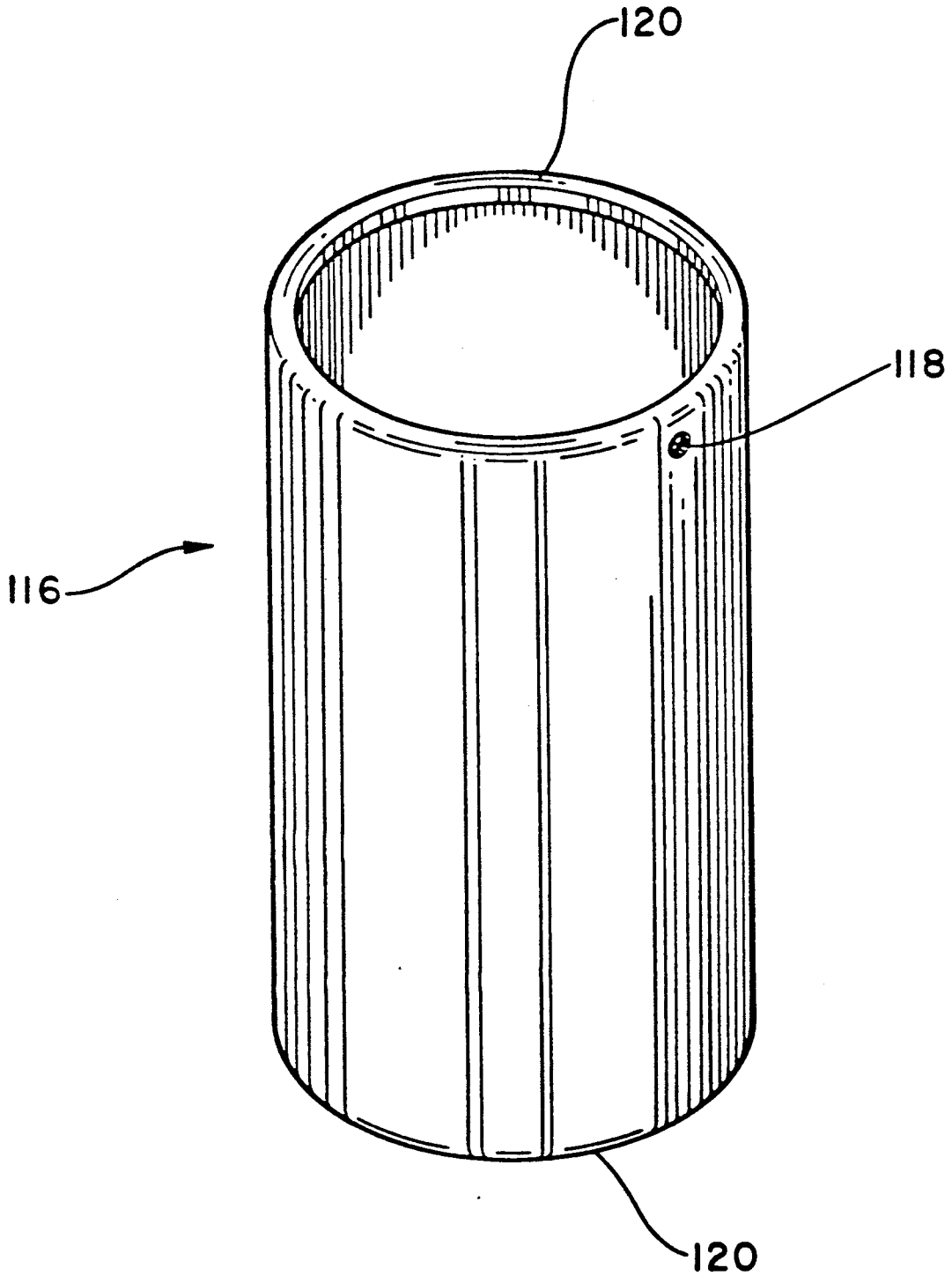
FIG. 3 shows an isometric view of a refrigerant vessel body.
Figure 5:
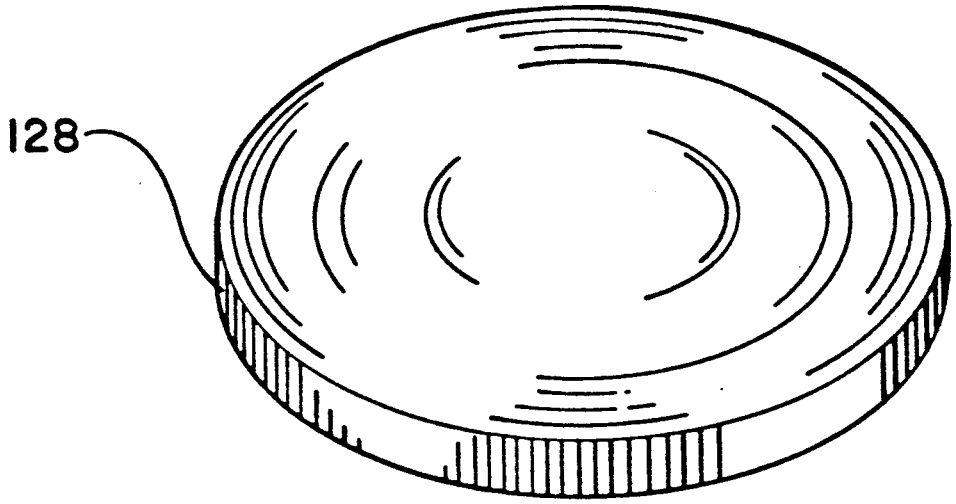
FIG. 5 shows an isometric view of a lower plug.
Figure 4:
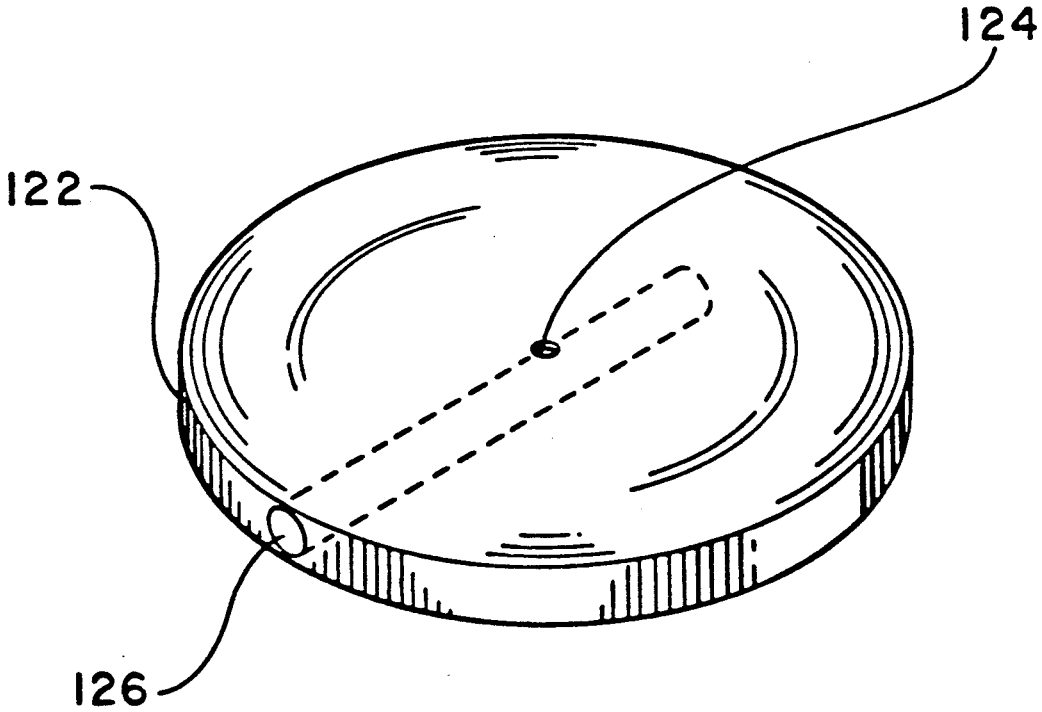
FIG. 4 shows an isometric view of an upper plug.

FIG. 1 is an exploded isometric view of the self-cooling device inserted in a beverage can of known construction for cooling the contents of the can. It should be noted that throughout the several FIGURES in these drawings, like elements will be denoted by like reference numerals. The preferred embodiment of the device includes a cylindrical refrigerant vessel 112 associated with rectangular thermal transfer fin-spacers 110. The spacers 110 that have planar surfaces are attached to the sides of the refrigerant vessel 112 and space the vessel 112 from the surfaces of the can 100 that contains the beverage 108 which is to be cooled. Preferably, they are spot welded to opposite sides of the vessel 112 and are parallel to one another. Their edges 115 touch the interior of the can 100, centrally spacing the refrigerant vessel 112 inside it. There spacers 110 insulate the vessel 112 from the can 100. The vessel tends to cool them, but the beverage tends to heat them; thus, the can 100 is not over-cooled.

Figure 6:
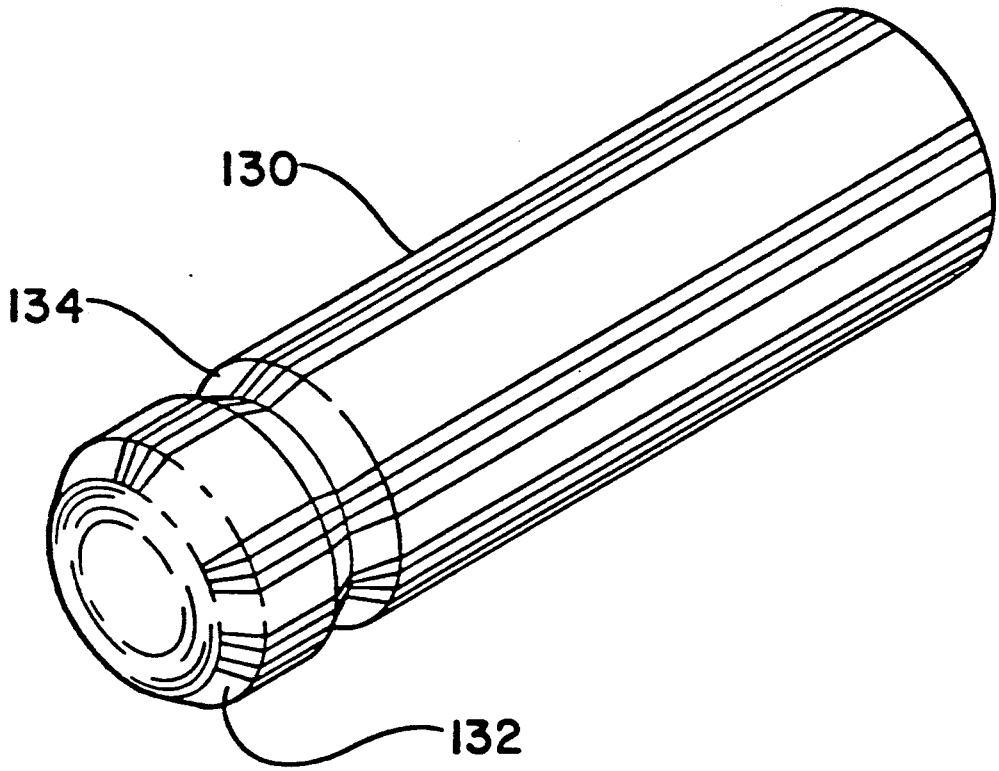
FIG. 6 shows an isometric view of a piston.
Figure 7:
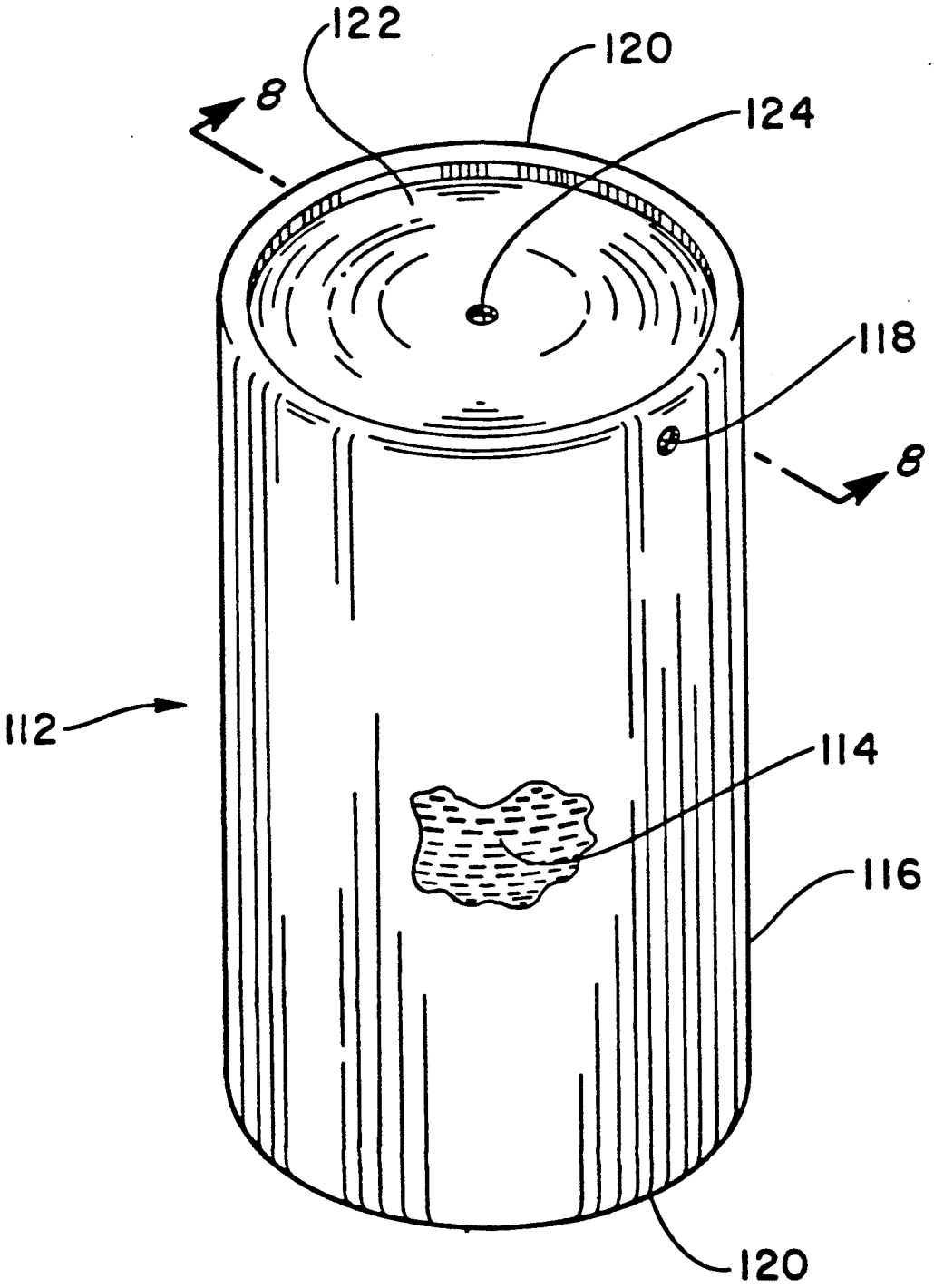
FIG. 7 shows an isometric view of a refrigerant vessel.

The refrigerant vessel 112 and its assembly and operation will be described with greater particularity with reference to FIGS. 3–8. The vessel consists of four pieces, a refrigerant vessel body 116 (FIG. 3), an upper plug 122 (FIG. 4), a lower plug 128 (FIG. 5), and a piston 130 (FIG. 6). The refrigerant, which is to be contained within the vessel, is preferably a common, inert, tasteless, odorless, liquified, atmospheric gas such as nitrogen or helium, or a mixture of them. The reason for providing these qualifications is to provide a gas which, when released into the beverage, changes the temperature of the beverage without altering the flavor or odor thereof. However, while these gases are preferred, other gases may be used based on their characteristic ability to provide the cooling effect without alteration of the beverage taste or odor.

The refrigerant vessel body 116 is to be formed of a comparatively heavy gauge tube section having a circular vent hole 118 formed near one of the refrigerant vessel rims 120, the vent hole 118 being defined at the same end (typically the upper end) of the cylinder adjacent to the upper plug 124 and aligned with the cylinder 126 in the upper plug. The cylinder 126 is defined preferably radially in the upper plug 124 with a diameter larger than the diameter of the vent hole 118 so that the movable piston 130 is also larger that the vent hole and cannot fit through the vent hole, but only butt up against the body 116 surrounding the vent hole.

Figure 8:
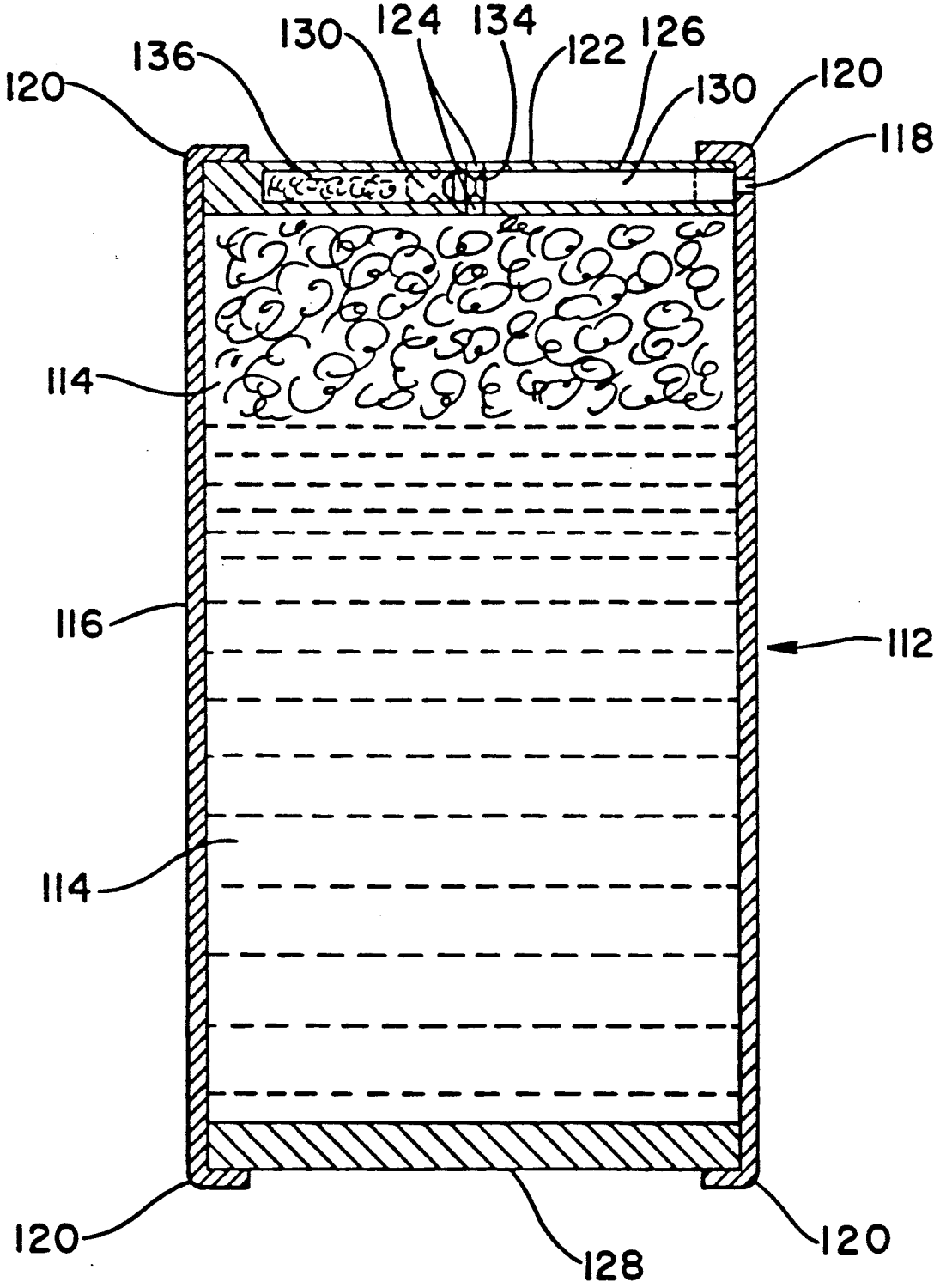
FIG. 8 shows a sectional view of a preferred refrigerant vessel taken along line 8—8 of FIG. 7.
Figure 9:
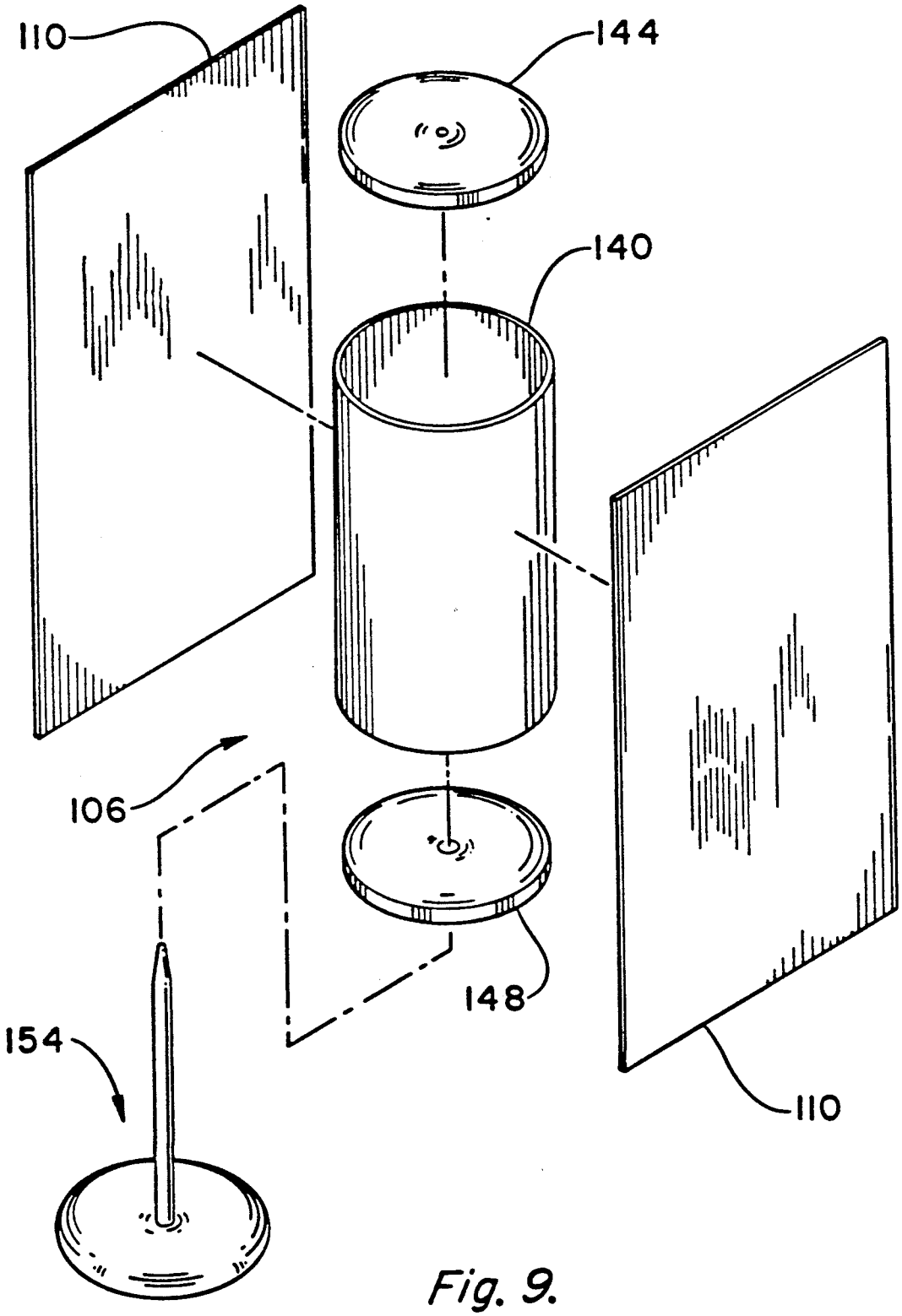
FIG. 9 shows an exploded isometric view of an alternative embodiment of the self-cooling device.
Figure 10:
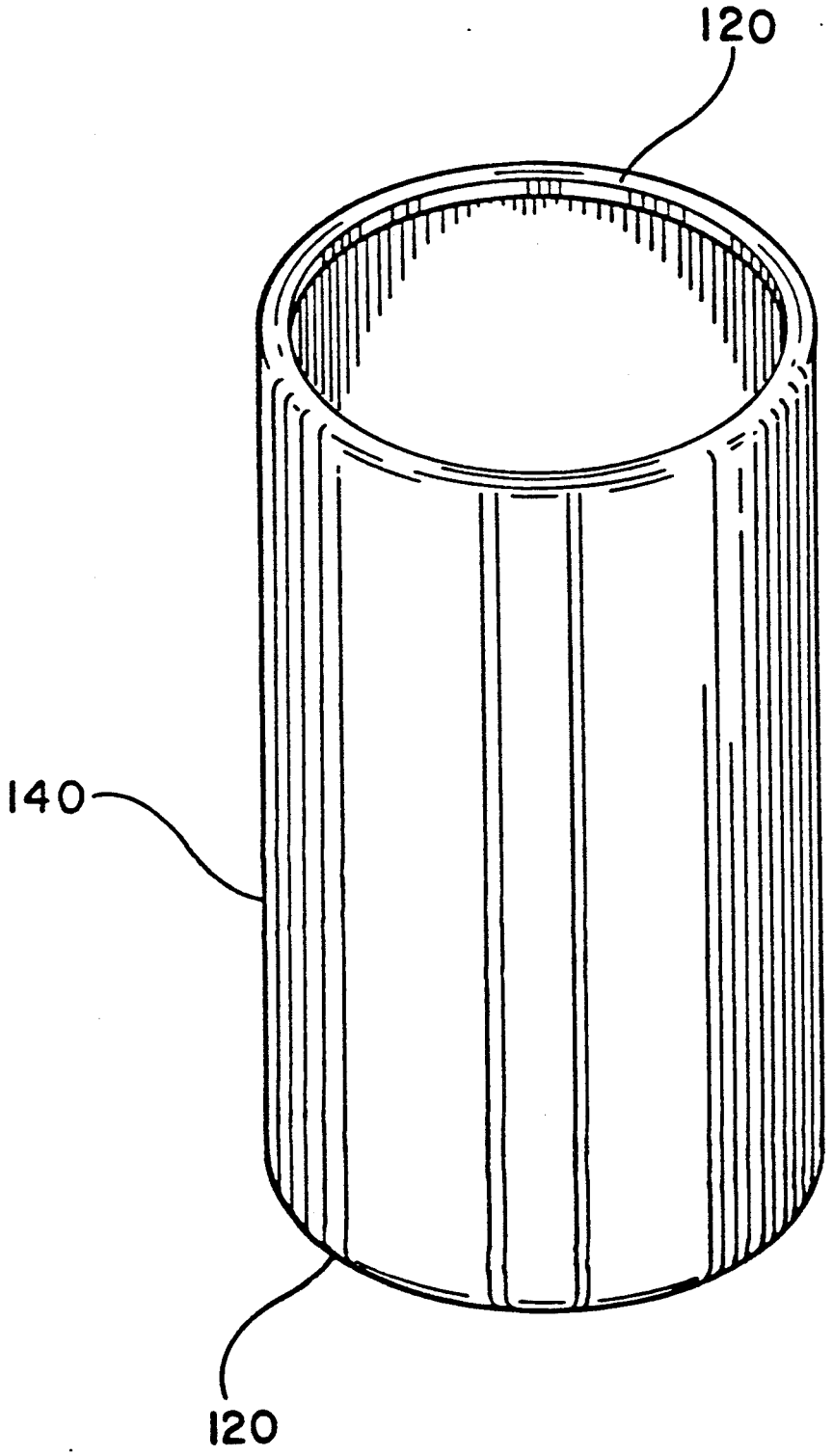
FIG. 10 shows an isometric view of an alternative refrigerant vessel body.
Figure 11:
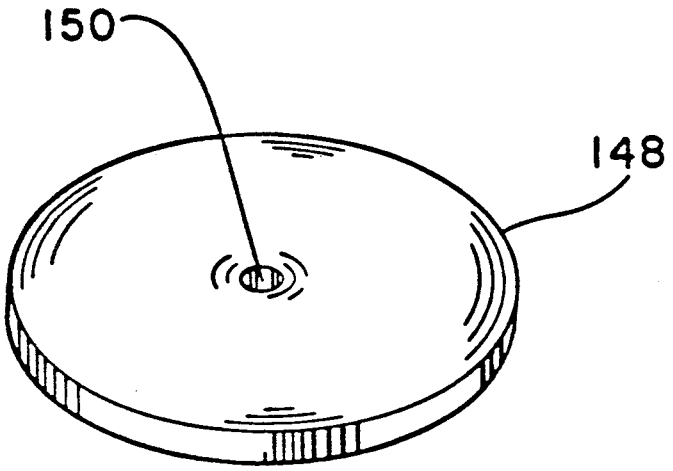
FIG. 11 shows an isometric view of an alternative lower plug.
Figure 13:
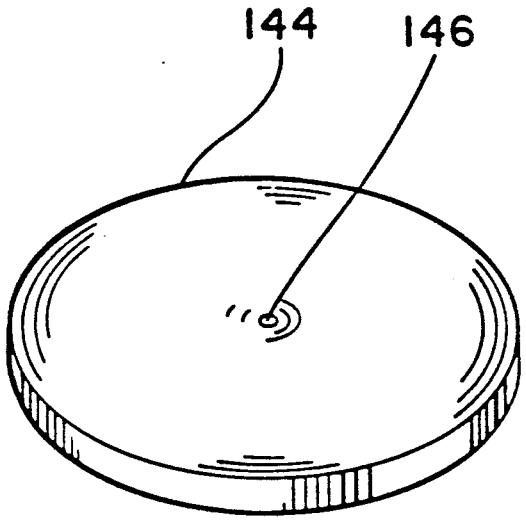
FIG. 13 shows an isometric view of an alternative upper plug.
Figure 12:
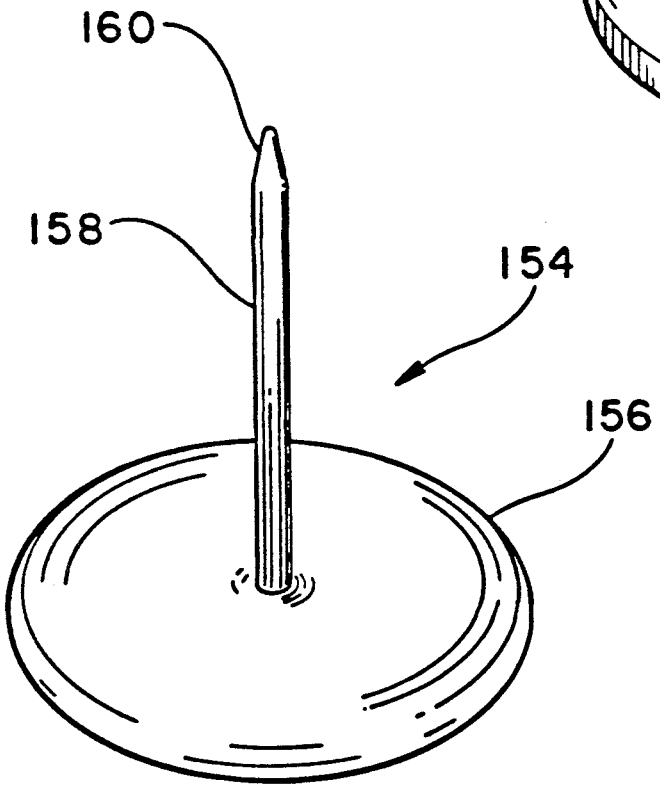
FIG. 12 shows an isometric view of an alternative piston.
Figure 14:
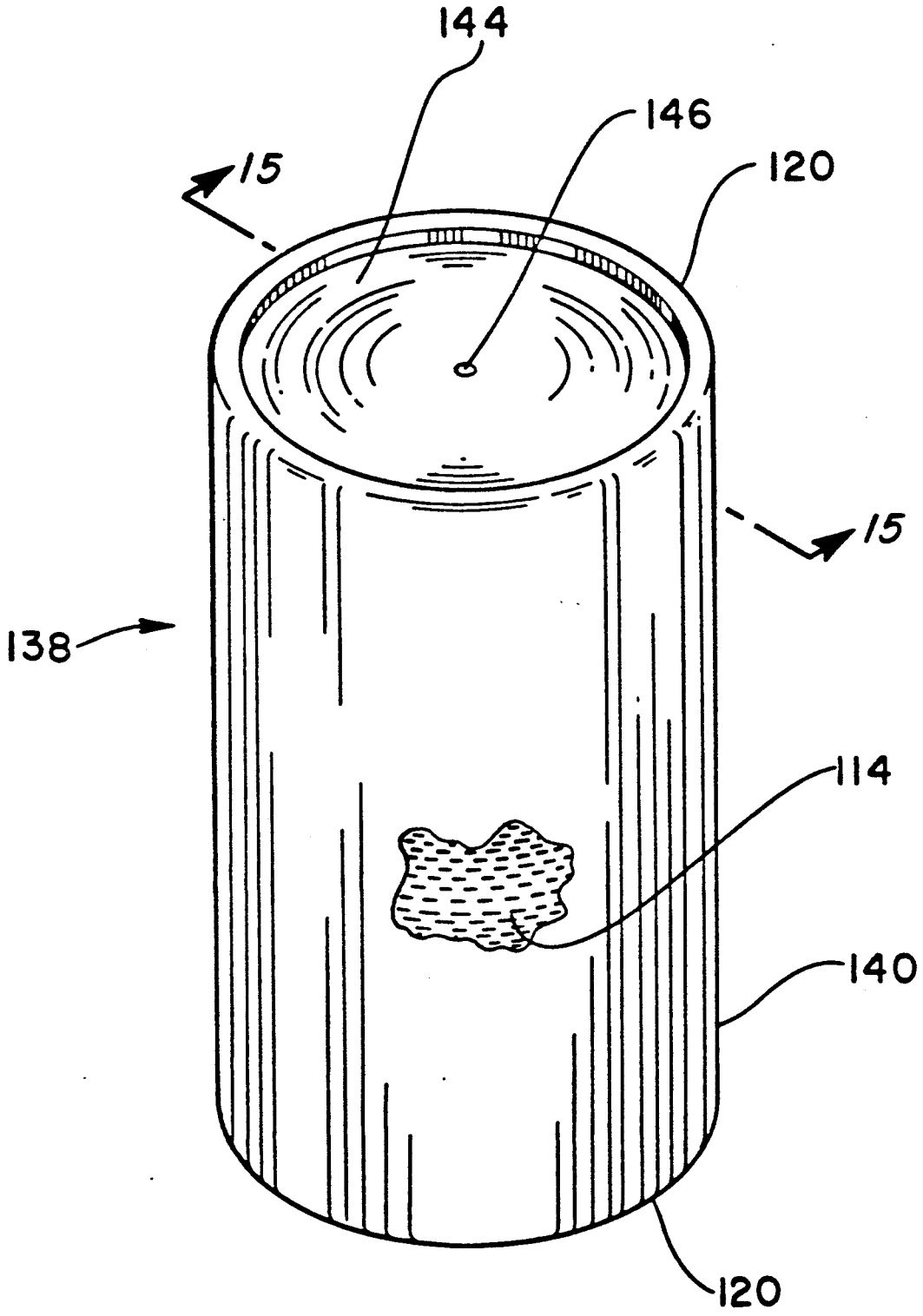
FIG. 14 shows an isometric view of an alternative refrigerant vessel.
Figure 15:
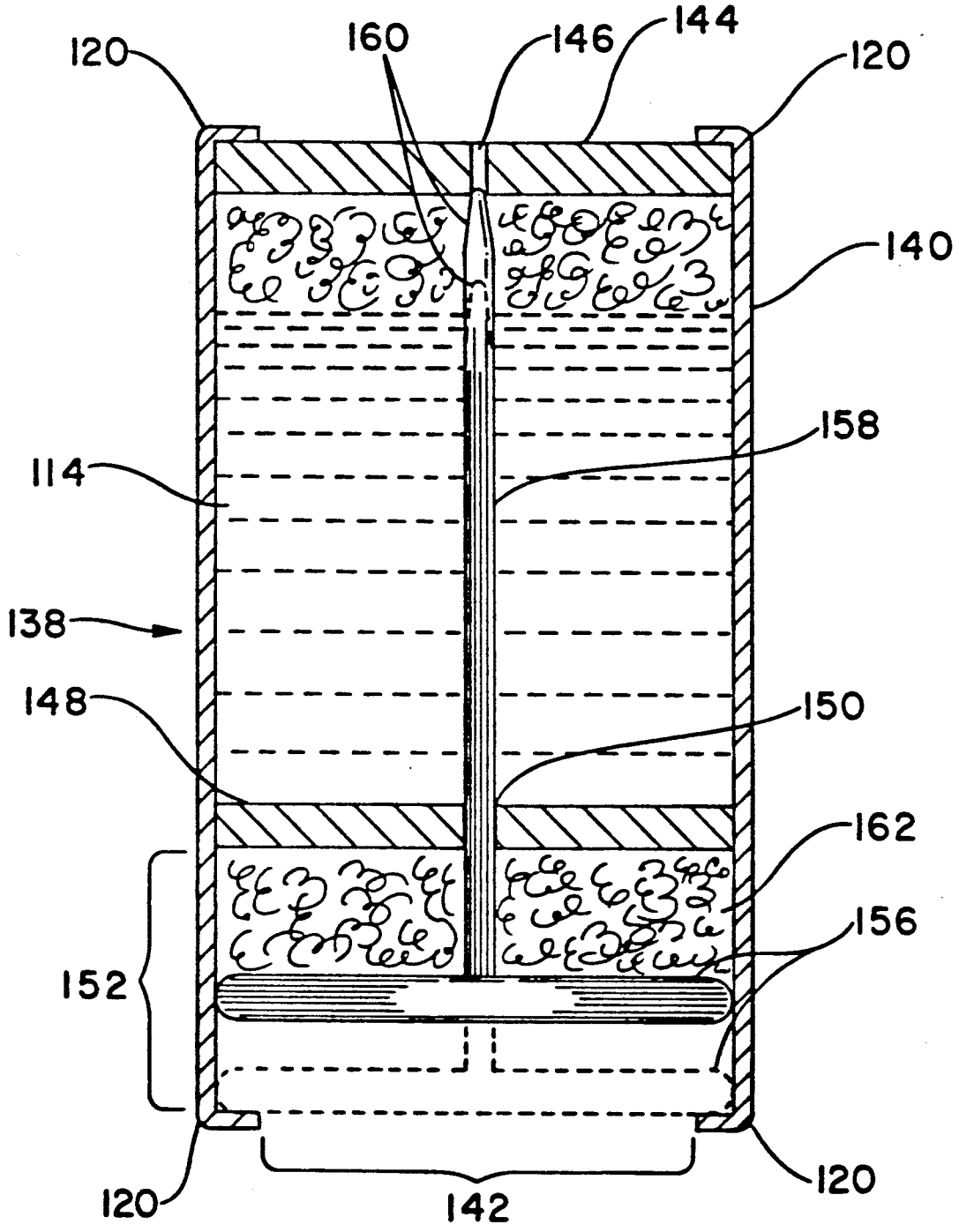
FIG. 15 shows an sectional view of an alternative refrigerant vessel, taken along line 15—15 of FIG. 14.
Figure 16:
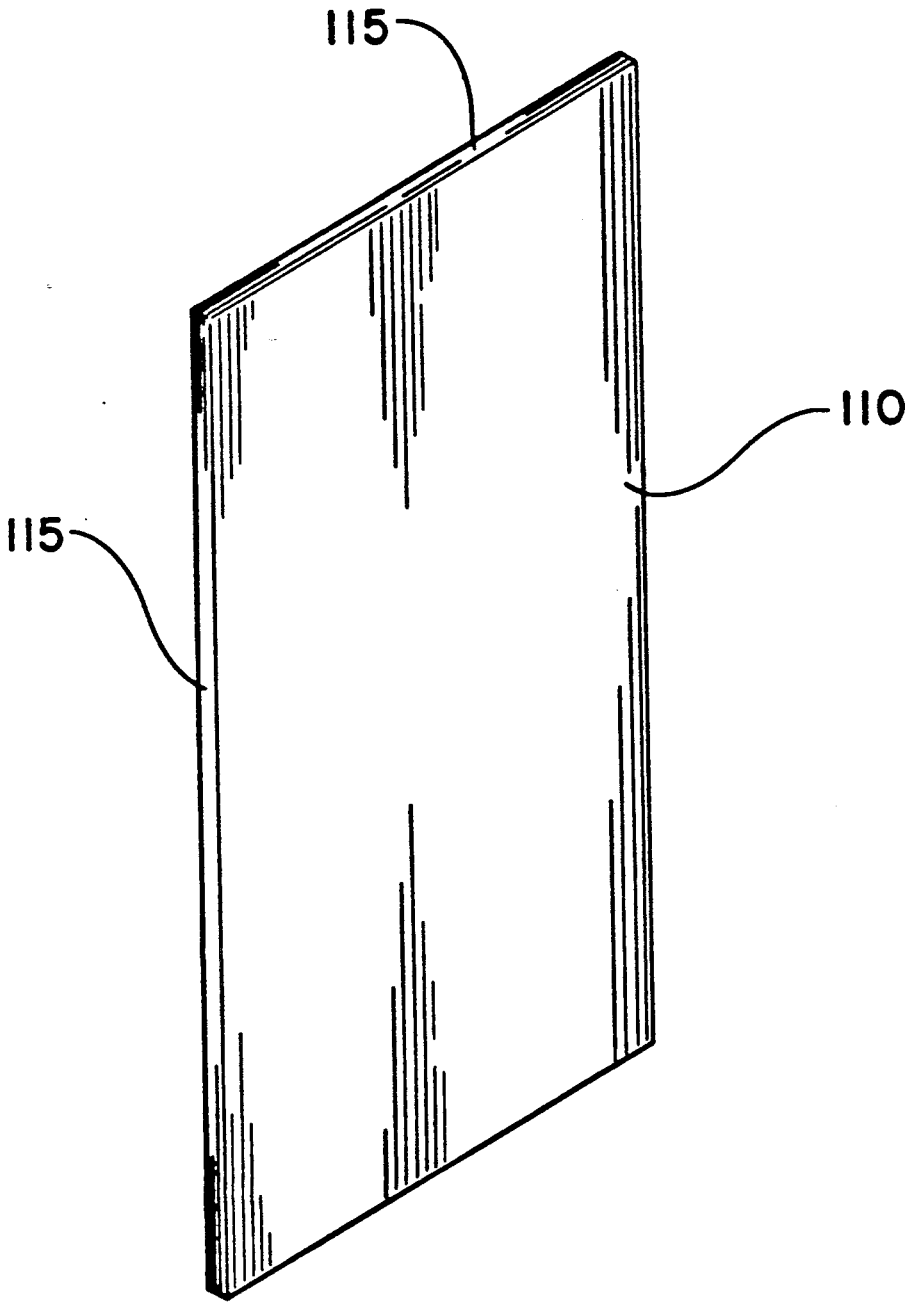
FIG. 16 shows an isometric view of a thermal transfer fin-spacer.

The upper and lower plugs 122, 128 are butted against the rims at the upper and lower ends of the refrigerant vessel body in a preferred form of the construction of the vessel. The lower plug in this preferred embodiment, shown especially at FIG. 8, is simply used to seal the refrigerant in the vessel. The upper plug 12, preferably a disc-shaped member, has an axial metering orifice 124 extending through it. This metering orifice 124 and the piston groove 134 will provide a communicating pathway for the refrigerant stored in the interior of the vessel 112 to escape the vessel, reaching the interior of the can. By providing the control means discussed below, the refrigerant may be evacuated through the metering orifice into the beverage stored in the beverage can to cool the beverage. It should be noted that the effect of the beverage touching the vessel does more to cool the beverage than its touching the refrigerant vapor bubbles.

The metering orifice is controlled using a plug cylinder 126 that intersects the orifice 124, and a piston 130 movable in this cylinder 126. This piston 130 shown in greater detail in FIG. 6 is a rod-shaped member that has a tapered piston section 132 formed on its innermost end as it fits within the cylinder. Near this innermost end, a piston groove 134 is defined formed around the circumference of the member 130. Positioning of this groove 134 relative to the metering orifice 124 opens or closes the orifice 124 to pass the refrigerant to the beverage to be cooled. The tapered piston section 132 is provided primarily to facilitate the piston's insertion into the cylinder 126. In its fully retracted position, the piston 130 adjoins the vent hole 118 which is at one end of the cylinder. In this position, it defines a pressure chamber 136.

In operation, a pressurized refrigerant 114 is provided in the vessel 120. When self-cooling action is desired, the refrigerant is allowed to escape from the vessel 112 whereby it expands and vaporizes. It immediately self-cools to its vapor point, thereby absorbing much of the heat of the beverage 108. The cryogenic refrigerant 114 is recommended because of the small volume displacement, results in limited reduction of the amount of beverage stored. The extremely cold vessel 112 is itself insulated from the beverage can by thermal transfer fin-spacers 110. Due to the respective contact area sizes, the fin-spacers efficiently cool the beverage 108 but not the can 100. The fin-spacers touch the vessel minimally, the beverage maximally, and the can minimally. Thus, little heat is absorbed by the vessel directly from the can, per se.

The vessel 112 itself is designed to be opened automatically as explained in mechanics below. The operation of the preferred embodiment of the invention may be generally summarized as follows.

When the vessel 112 is assembled, the piston 130 must be frozen in place before the upper plug 122 is inserted into the vessel body 116. Otherwise, the piston 130 will interfere with the plugging operation by getting in the way, or it could fall out completely. Therefore, prior to assembly of the vessel, it is necessary to freeze the piston 130 in place, in a closed position; that is, with the groove 134 not adjoining the metering orifice 124. This is accomplished as follows. The plug cylinder is lubricated with edible lubricating sealant. The piston is inserted and held in the closed position; the plug is immersed in refrigerant 114, which freezes the sealant holding the piston 130 in the closed position. However, alternative modes may be provided for holding the piston in place that are not dependent on this refrigeration/freezing effect. Typically when the piston 130 is inserted into the cylinder 126 in the assembly of the device, air is pressurized in the chamber 136. The pressurized air tends to eject the piston 130 but cannot do so. The device 106 is thereafter inserted into and sealed inside the beverage can 100. With the warm temperature of the beverage, the sealant 164 that surrounds the piston 130 melts, and because of the pressure differential, the piston 130 may be ejected into an open position where the groove 134 adjoins the orifice 124. Escaping refrigerant 114 gradually flows through the orifice 124 and groove 134, slightly pressurizing the can 100. This can pressure is transmitted to piston 130 via vent hole 118. The piston 130 is pushed back into the cylinder 126 to its closed position, where the groove 134 does not adjoin orifice 124. This position is maintained because of the pressurized state established within the can until the can 100 is opened, whereupon the pressure in the can drops, allowing the pressurized air in chamber 136 to again eject the piston 130 to an open position. The escaping refrigerant 114 then expands and absorbs the heat of the beverage as described above.

An alternative embodiment of this invention, though somewhat different structurally, operates on the same generally principles and comprises similar elements, and is disclosed in FIGS. 9-15. It includes especially, in addition to the thermal transfer fin-spacers 110, an alternative vessel assembled from body part 140, an upper plug 144 which lacks the chamber and piston of the previous embodiments, alternative lower plug 148 which seals the refrigerant chamber of the vessel at a distance above the bottom edge of the sidewalls 140, and alternative piston 154 which carries and positions alternative piston extension 158 relative to the metering orifice 146 which incorporated axially into the upper plug.

As described above, the upper plug 148 of the alternative embodiment, although containing an axial metering orifice 146 as in the other embodiment, contains no similar cylinder and piston. Rather, it is provided primarily to seal the upper end of the alternative refrigerant vessel 138. The alternative lower plug 148 is a disc-shaped member having a lower plug hole 150 formed axially therethrough. When the piston extension 158 extends through the lower plug hole 150, the combination hermetically seals the lower end of the refrigerant vessel. The lower plug 148 is placed within the alternative refrigerant vessel body 140 to divide the vessel into upper and lower chambers, the upper chamber containing the refrigerant 114, the lower containing the piston 154. Preferably, an edible sealing lubricant such as vegetable oil or the like is provided on the edges of the piston adjoining the walls of the vessel and also surrounding the piston extension 158 where it passes through the lower plug 148 to facilitate a hermetic sealing fit between the vessel walls 120 and piston 154 and between lower plug 148 and piston extension 158.

The theory of operation is as described above for the preferred embodiment. Specifically, when piston 154 is inserted in lower chamber or cylinder 152, air is pressurized in the chamber 162. The pressurized air tends to eject the piston 154, although the piston is held in place by the lower extremities of the side walls 120 or other locking means. Prior to the assembly of the vessel 138 in the can 100, the piston 154 must be frozen in a position such that the tapered tip 160 of the piston extension 158 extends into and plugs the metering orifice 146, preventing the refrigerant 114 from escaping through the metering orifice 146. This is accomplished as follows. Before the upper plug 144 and the piston 154 are assembled in vessel 138, the outside edge of the piston 156 which will contact the side walls 120 and the piston extension 158 are lubricated with an edible lubricating sealant. The piston 154 is inserted to a position where the tapered tip 160 of the piston extension 158 will extend into and plug the metering orifice 146 when the upper plug 144 is mounted on vessel 138. The piston 154 is held in this position. Air is trapped in the lower chamber 162 when the outside edge of the piston 156 first contacts the side walls 120. This air becomes pressurized as the insertion of the piston 154 is continued until the tapered tip 160 of the piston extension 158 is in a position where it will extend into and plug the metering orifice 146 when the upper plug 144 is mounted. When the upper chamber 114 is filled with the very cold cryogenic refrigerant, the edible lubricating sealant freezes, thus holding the piston 154 frozen in this position. The upper plug 144 is now mounted on the vessel 138, and the tapered tip 160 of the piston extension 158 extends into and plugs the metering orifice 146. The pressurized air in the lower chamber 162 tends to eject the piston 154 but cannot do so. The sealant will remain frozen for several minutes.

When the device 106 is sealed into the beverage can, the warm temperature of the beverage 108 causes the frozen sealant to melt and, because the air in the lower chamber 162 is pressurized, the piston and the extension 158 to move slightly away from the metering orifice 146 until escaping refrigerant gradually pressurizes the sealed can 100. This increase in can pressure is transmitted to the piston 154 via the vent hole 142. The piston 154 is then pushed back into the cylinder 152 to the closed position where the extension tip 160 plugs the orifice 146, sealing the remaining refrigerant in the vessel. When the can 100 is opened, the pressure drops allowing the pressurized air in chamber 162 to again eject the piston to the open position where the tip 160 is withdrawn from the orifice 146. At this point, the refrigerant can escape, vaporize, thus self-cooling the vessel and the beverage.

It will be appreciated by a person of skill in the art that the above embodiments may allow for variations in manufacturing, assembly and design which fall within the scope of the present invention. Further, two devices containing hypergolic gases could be used in a self-heating embodiment of this invention. Such gases would be allowed to escape into a common combustion chamber where they would spontaneously ignite and heat the beverage. If the gases were oxygen and hydrogen, their exhaust fumes would be ordinary steam that could be allowed to vent into the beverage. Other alternatives are available, such that the scope of this invention is to be limited only by the following claims.

I claim:

1. An internal self-cooling device for a beverage container comprising a refrigerant vessel means for holding a pressurized evaporative refrigerant, said vessel means comprising a refrigerant vessel body defined by cylindrical side walls having upper and lower rims, a lower plug positioned within said body at a distance from said lower rim of said body dividing said body into upper and lower chambers and hermetically sealing said upper chamber of said body, a lower plug hole formed axially through said lower plug, and an upper plug hermetically sealing said upper rim of said body, a metering orifice means formed axially through said upper plug for regulating the rate of escape of said refrigerant from said vessel, an automatic pressure actuated means for releasing said refrigerant from said upper chamber, comprising a plug cylinder contained in the walls of the lower chamber of said body between said lower plug and said lower rim, a cylinder vent hole defined at the level of said lower rim, a piston consisting of a piston base positioned within said cylinder and slidable in said walls between said lower plug and said lower rim, thereby trapping air in a space between said lower plug and said piston a piston extension extending through said plug hole, and ending in a tip that fits into said orifice to open or close said metering orifice, whereby when said vessel means is inserted into said container and said container is then sealed and slightly pressurized, said pressure is transmitted to said piston via said vent hole, positioning said piston at a position wherein said extension tip engages said orifice, but when said container is depressurized upon opening, compressed air in said space ejects said piston to a postion wherein said extension tip disengages said orifice allowing said refrigerant to expand into said beverage and self-cool said vessel, thereby cooling said beverage.

2. The self-cooling device of claim 1, wherein said lower plug is positioned in said body at a distance from said lower rim approximately one-fifth the height of said body.

3. The self-cooling device of claim 1, wherein said pressure actuated means includes a lubricating sealant contained in said cylinder and hermetically sealing said piston and said cylinder.

4. The self-cooling device of claim 3, wherein said sealant is edible and temperature responsive whereby upon freezing said sealant, said piston is not free in said cylinder to allow escape of said refrigerant.

5. The self-cooling device of claim 4, wherein said sealant is heat responsive whereby upon heating said sealant, said piston is free to move in said cylinder to allow escape of said refrigerant.

6. The self-cooling device of claim 1, further including spacing means comprising at least one spacer secured to said vessel and having a large area contacting the beverage and a small area contacting said vessel or container, thereby providing efficient cooling of said beverage but not said container.

7. The self-cooling device of claim 6, wherein said spacing means comprises a pair of thermal transfer fin-spacers attached to said vessel and dimensioned to touch the sides of said container and hold the vessel upright in the container.

8. The self-cooling device of claim 1, wherein said refrigerant is a liquified, atmospheric gas.

* * * * *